US011032886B2

(12) United States Patent
Chen et al.

(10) Patent No.: US 11,032,886 B2
(45) Date of Patent: Jun. 8, 2021

(54) LIGHT EMITTING DIODE DRIVER AND DRIVING METHOD THEREOF

(71) Applicant: Novatek Microelectronics Corp., Hsinchu (TW)

(72) Inventors: Tuo-Kuang Chen, Hsinchu (TW); Hsiang-Yi Chiu, New Taipei (TW); Chiun-He Lin, Pingtung County (TW); Yao-Cheng Lin, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/932,858

(22) Filed: Jul. 20, 2020

(65) Prior Publication Data

US 2021/0037625 A1 Feb. 4, 2021

Related U.S. Application Data

(60) Provisional application No. 62/881,335, filed on Jul. 31, 2019.

(51) Int. Cl.
*H05B 45/325* (2020.01)
*H05B 45/10* (2020.01)

(52) U.S. Cl.
CPC ..... *H05B 45/325* (2020.01); *H05B 45/10* (2020.01)

(58) Field of Classification Search
CPC ..... H05B 45/10; H05B 45/325
See application file for complete search history.

(56) References Cited

U.S. PATENT DOCUMENTS

2012/0013265 A1* 1/2012 Yang ..... H05B 45/37 315/246
2012/0127214 A1* 5/2012 Han ..... H05B 45/46 345/690
2013/0088164 A1* 4/2013 Sun ..... H05B 45/20 315/210
2016/0360587 A1* 12/2016 Wang ..... H05B 45/20

* cited by examiner

*Primary Examiner* — Raymond R Chai
(74) *Attorney, Agent, or Firm* — JCIPRNET

(57) ABSTRACT

The invention provides a light-emitting diode (LED) driver and a driving method thereof. The LED driver includes a brightness code calculation circuit, a driving current generation circuit and a control circuit. The brightness code calculation circuit is configured to to receive a pulse width modulation (PWM) signal and perform a calculation operation comprising calculating a duty cycle of the PWM signal with respect to a period of the PWM signal and generating a brightness code according to the duty cycle of the PWM signal. The driving current generation circuit is configured to generate a driving current according to the brightness code. The control circuit is configured to detect a plurality of brightness codes generated by the brightness code calculation circuit repeatedly performing the calculation operation and determine whether or not to adjust an execution frequency of the calculation operation of the brightness code calculation circuit according to the brightness codes.

8 Claims, 3 Drawing Sheets

LIGHT EMITTING DIODE DRIVER AND DRIVING METHOD THEREOF

CROSS-REFERENCE TO RELATED APPLICATION

This application claims the priority benefit of U.S. Provisional application Ser. No. 62/881,335, filed on Jul. 31, 2019. The entirety of the above-mentioned patent application is hereby incorporated by reference herein and made a part of this specification.

BACKGROUND

Field of the Invention

The invention relates to a light-emitting diode (LED) driver and a driving method thereof and more particularly, to an LED driver capable of adjusting a calculation frequency of brightness codes and a driving method thereof.

Description of Related Art

Generally speaking, a back-light source of a display panel is composed of light emitting diodes (LEDs). In a technical field related to an LED driving technique, brightness of the LEDs is usually determined by a duty cycle of a pulse width modulation (PWM) signal. FIG. 1 is a schematic block diagram illustrating a light emitting diode (LED) driving system. Referring to FIG. 1, an LED driving system 100 includes an LED driver 110. The LED driver 110 includes a brightness code calculator 111 and a driving current generation circuit 113. The brightness code calculator 111 is in charge of calculating a duty cycle of a pulse width modulation (PWM) signal that is sent in. Specifically, the brightness code calculator 111 may calculate the duty cycle that is a ratio of an active time (in which the PWM signal is at an active voltage level, such as high voltage level) to the period of the PWM signal 101 and thereby generate a plurality of brightness codes 112 according to the calculated duty cycle. The driving current generation circuit 113 outputs corresponding driving currents to LEDs respectively according to the plurality of brightness codes 112.

In a normal operation, the brightness code calculator 111 continuously generates the brightness codes 112, so as to instantly update the brightness required by the LED strings 120. However, when an abnormality phenomenon occurs to the PWM signal 101 received by the brightness code calculation circuit 111 (e.g., a signal phase change caused by switching different display cards), it is directly reflected to the brightness codes 112, which leads to unstable brightness of the LED strings 120 and causes visual flickers. In addition, since the brightness code calculator 111 has to keep calculating the duty cycle of the PWM signal and generate the brightness codes, the LED driver 110 may produce a great amount of power consumption.

SUMMARY

The application is capable of adjusting an execution frequency of a calculation operation of a brightness code calculation circuit of a light emitting diode (LED) driver to prevent an issue of brightness flickers from occurring to LEDs caused by an abnormal state.

The application provides an LED driver and a driving method thereof. The LED driver includes a brightness code calculation circuit, a driving current generation circuit and a control circuit. The brightness code calculation circuit is configured to to receive a pulse width modulation (PWM) signal and perform a calculation operation comprising calculating a duty cycle of the PWM signal with respect to a period of the PWM signal and generating a brightness code according to the duty cycle of the PWM signal. The driving current generation circuit is coupled to the brightness code calculation circuit, and configured to generate a driving current according to the brightness code. The control circuit is coupled to the brightness code calculation circuit, and configured to detect a plurality of brightness codes generated by the brightness code calculation circuit repeatedly performing the calculation operation and determine whether or not to adjust an execution frequency of the calculation operation of the brightness code calculation circuit according to the brightness codes.

In an embodiment of the application, the adjustment of the execution frequency of the calculation operation of the brightness code calculation circuit is determined by generating a control signal sent to the brightness code calculation circuit, in response to a comparison result indicating that the plurality of brightness codes is the same.

In an embodiment of the application, the control circuit is a dynamic window modulator configured to adjust the execution frequency of the calculation operation of the brightness code calculation circuit according to at least one of the control signal, the PWM signal and the plurality of brightness codes.

In an embodiment of the application, the brightness code calculation circuit includes a calculation circuit and a memory circuit. The calculation circuit is configured to calculate the duty cycle of the PWM signal with respect to the period of the PWM signal and generate the brightness code according to the duty cycle. The memory circuit is configured to store the brightness code.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
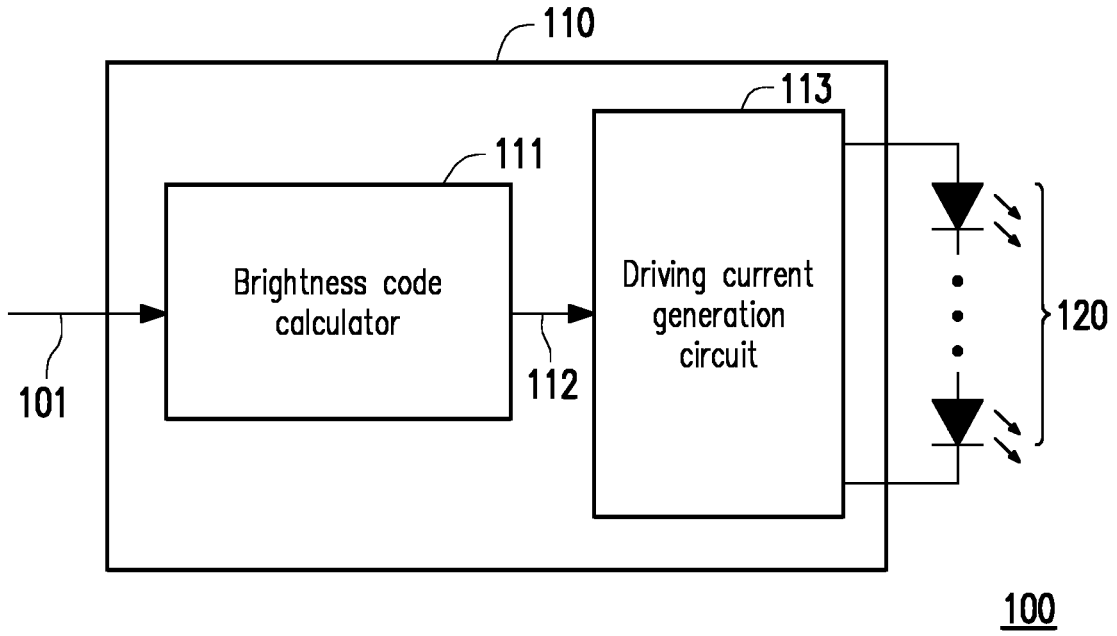
FIG. 1 is a schematic block diagram illustrating a light emitting diode (LED) driving system.

Reference will now be made in detail to the exemplary embodiments of the disclosure, examples of which are illustrated in the accompanying drawings. Wherever possible, the same reference numbers are used in the drawings and the description to refer to the same or like parts.

Figure 2:
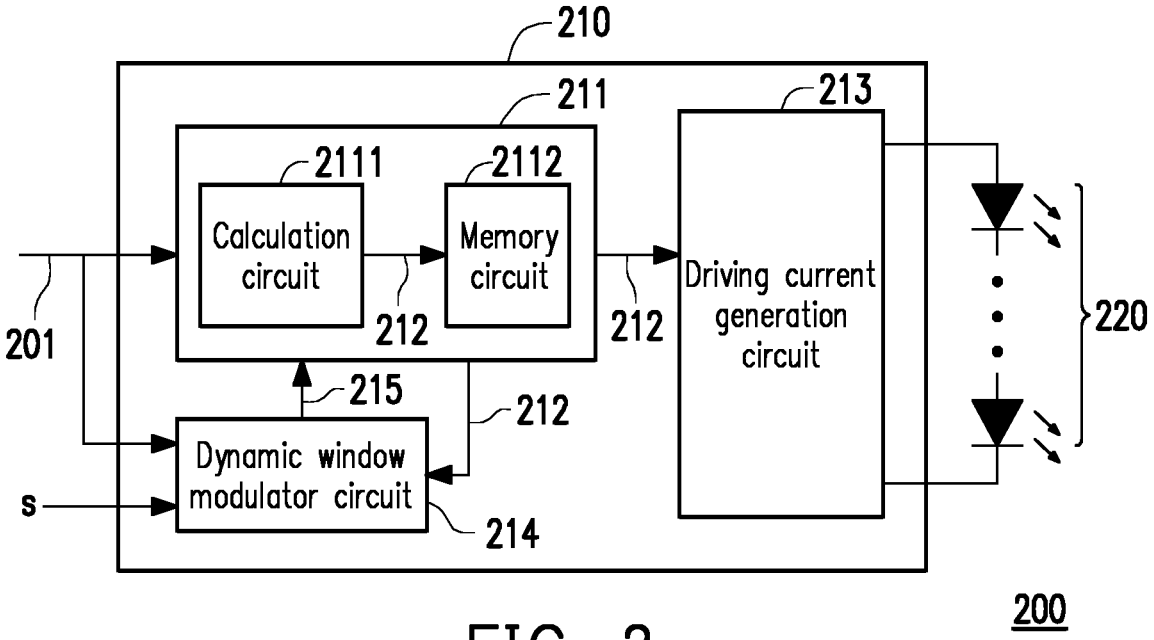
FIG. 2 is a schematic diagram of an LED driver according to an embodiment of the application.

FIG. 2 is a schematic block diagram of an LED driving system according to an embodiment of the application. Referring to FIG. 2, an LED driving system 200 includes an LED driver 210 and a load apparatus including one or more LED strings 220. The LED driver 210 may generate a driving current to drive the LED string 220. The LED driver 210 includes a brightness code calculation circuit 211, a driving current generation circuit 213 and a dynamic window modulator 214.

The brightness code calculation circuit 211 receives a pulse width modulation (PWM) signal 201 and performs a calculation operation, including to calculate a duty cycle of the PWM signal 201 with respect to a period of the PWM signal and to generate a brightness code 212 corresponding to the calculated duty cycle. Specifically, the duty cycle of the PWM signal 201 is a ratio (e.g., 20%) of an active time, in which the PWM signal 201 is at an active voltage level such as a high voltage level, to the period of the PWM signal 201. The brightness code calculation circuit 211 may continuously or intermittently execute the calculation operation to obtain a plurality of brightness codes 212 with respect to a plurality of periods (which may be consecutive or not) of the PWM signal 201. Continuously executing the calculation operation and intermittently executing the calculation operation are regarded as repeatedly executing the calculation operation. Furthermore, the brightness code calculation circuit 211 may also be divided in to a calculation circuit 2111 and a memory circuit 2112. The calculation circuit 2111 is configured to execute the calculation operation described above. The memory circuit 2112 may store the brightness code 212 generated by the calculation circuit 2111 executing the calculation operation and may update the stored brightness code 212 every time when the calculation circuit 2111 generates the brightness code.

The driving current generation circuit 213 may generate a driving current according to each of the brightness codes 212 generated by the brightness code calculation circuit 211 to drive the LED string 220. A first control signal s may be sent from outside the LED driver 210 to the brightness code calculation circuit 211 and the dynamic window modulator 214. When the first control signal s is at a first voltage level (e.g., a low voltage level), the brightness code calculation circuit 211 may continuously execute the calculation operation on the PWM signals 201 and continuously update the brightness code 212, which ensures that the LED string 220 is capable of instantly presenting the brightness as required. When the first control signal s is at a second voltage level (e.g., a high voltage level), the brightness code calculation circuit 211 may intermittently execute calculation operation on the PWM signals 201 based on an execution frequency, and the dynamic window modulator 214 may detect a plurality of brightness codes 212 and generate a control signal 215 according to the plurality of brightness codes 212. The control signal 215 is sent to the brightness code calculation circuit 211 for adjusting the execution frequency of the calculation operation.

Specifically, the dynamic window modulator 214 may be configured to compare the brightness codes 212 to examine whether the brightness codes 212 are the same or not, and thereby determine whether or not to adjust the execution frequency of the calculation operation of the brightness code calculation circuit 211 according to a comparison result indicating the brightness codes are the same or not. The control signal 215 sent to the brightness code calculation circuit 211 is utilized for indicating whether or not to adjust the execution frequency of the calculation operation. In response to the comparison result indicating that the brightness codes are the same, the dynamic window modulator 214 generates the control signal 215 sent to the brightness code calculation circuit 211 to adjust the execution frequency of the calculation operation of the brightness code calculation circuit 211. In response to the comparison result indicating that the brightness codes are not the same, the dynamic window modulator 214 generates the control signal 215 sent to the brightness code calculation circuit 211 to not to adjust the execution frequency of the calculation operation of the brightness code calculation circuit 211. In another aspect, intermittently executing the calculation operation is intermittently suspending the calculation operation. The brightness code generation circuit 211 may suspend the calculation operation during some periods of an abnormal PWM signal and not generate the brightness codes. In this circumstance, the brightness code 212 stored by the memory circuit 2112 is the brightness code calculated before the occurrence of the abnormal PWM signal. In this way, the driving current generation circuit 213 may output the driving current according to a previous brightness code 212 to prevent the issue of brightness flickers. For example, when a computer system (where the LED driver 210 is used) equipped with two graphic cards performs graphic card switching, the PWM signal input to the LED driver 210 before and after graphic card switching may be not synchronized and is regarded as an abnormal PWM signal, and the LED strings may generate flickers. By configuring the first control signal s to be at a voltage level that controls the brightness code generation circuit 211 to intermittently execute calculation operation, the periods of abnormal PWM signal can be ignored and the driving current may be more stable.

In brief, the application may determine to intermittently execute/suspend the calculation operation of the brightness code calculation circuit 211 through the first control signal s to maintain brightness uniformity of the LED string 220. Furthermore, the brightness code calculation circuit 211 may resume the calculation operation when the first control signal s is converted from the second voltage level to the first voltage level. Or, alternatively, the brightness code calculation circuit 211 may suspend the calculation operation of the brightness code calculation circuit 211 within a predetermined time period and resume the aforementioned calculation operation after the predetermined time period is passed. Two embodiments are provided to describe details related to adjusting the calculation operation of the brightness code calculation circuit 211 by the dynamic window modulator 214 according to the PWM signal 201 or the plurality of brightness codes 212.

Figure 3:
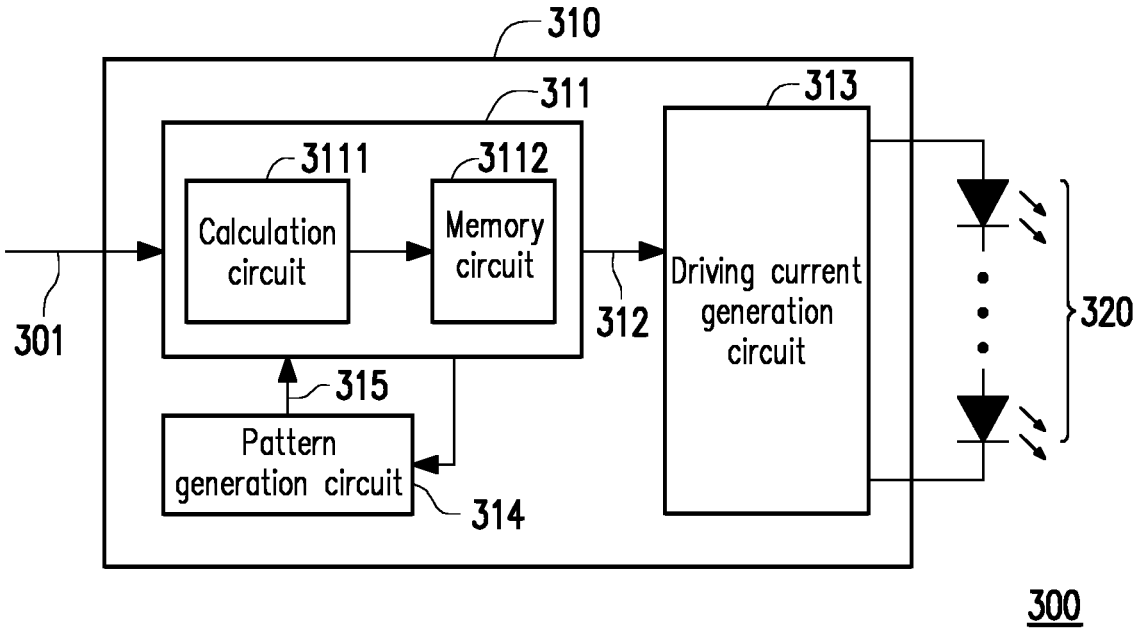
FIG. 3 is a schematic block diagram of an LED driving system according to an embodiment of the application.

FIG. 3 is a schematic block diagram of an LED driving system according to an embodiment of the application. Referring to FIG. 3, an LED driving system 300 includes an LED driver 310 and one or more LED strings 320. The LED driver 310 may generate a driving current to drive each of the LED strings 320. The LED driver 310 includes a brightness code calculation circuit 311, a driving current generation circuit 313 and a dynamic window modulator. The brightness code calculation circuit 311 may be further divided in to a calculation circuit 3111 and a memory circuit 3112. Details related to the brightness code calculation circuit 311, the calculation circuit 3111, the memory circuit 3112, the driving current generation circuit 313 and the LED string 320 may be inferred with reference to the description contents related to same elements in the embodiment illustrated in FIG. 2 and thus, will not be repeated.

In the present embodiment, the dynamic window modulator may be implemented by a pattern generation circuit 314. The pattern generation circuit 314 may detect a plurality of brightness codes calculated by the brightness code calculation circuit 311 to determine whether a plurality of continuous brightness codes 312 have the same value. When N brightness codes 312 detected by the pattern generation circuit 314 have the same value, an execution frequency of the calculation operation of the brightness code calculation circuit 311 is reduced from one calculation per period to one calculation per two periods. Furthermore, when the number of the brightness codes 312 having the same value is accumulated to 2N, the execution frequency of the calculation operation of the brightness code calculation circuit 311 is again reduced from one calculation per two periods to one calculation per three or more periods. N is an integer greater than or equal to 2. In another embodiment, the pattern generation circuit 314 may also detect the plurality of brightness codes 312 within a predetermined time period to reduce the execution frequency of the calculation operation of the brightness code calculation circuit 311 in a condition that the plurality of brightness codes 312 have the same value within the predetermined time period.

In this way, in the condition that the PWM signal 301 temporarily does not change (i.e., the plurality of brightness codes 312 have the same value), the number of times of the calculation of the brightness code calculation circuit 311 may be reduced, thereby indirectly preventing the issue of brightness flickers from occurring to the LED string 320 due to the abnormal state as well as achieving an effect of reducing static power consumption at the same time.

Figure 4:
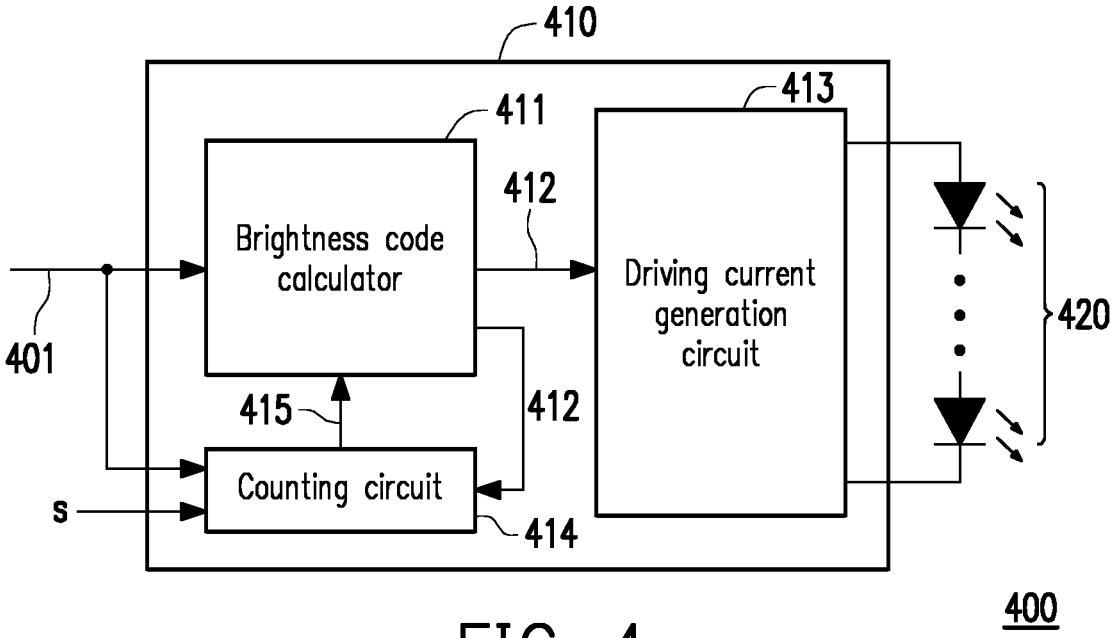
FIG. 4 is a schematic block diagram of an LED driving system according to an embodiment of the application.

FIG. 4 is a schematic block diagram of an LED driving system according to an embodiment of the application. Referring to FIG. 4, an LED driving system 400 includes an LED driver 410 and one or more LED strings 420. The LED driver 410 may generate a driving current to drive each of the LED strings 420. The LED driver 410 includes a brightness code calculation circuit 411, a driving current generation circuit 413 and a dynamic window modulator. The brightness code calculation circuit 411 may be further divided in to a calculation circuit 4111 and a memory circuit 4112. Details related to the brightness code calculation circuit 411, the calculation circuit 4111, the memory circuit 4112, the driving current generation circuit 413 and the LED string 420 may be inferred with reference to the description contents related to same elements in the embodiment illustrated in FIG. 2 and thus, will not be repeated.

In the present embodiment, the dynamic window modulator 214 may be implemented by a counting circuit 414. The counting circuit 414 may receive a PWM signal 401 and the first control signal s to determine whether to reduce an execution frequency of the brightness code calculation circuit 411 according to the PWM signal 401. The counting circuit 414 may generate a second control signal 415 in response to the first control signal s at a high voltage level, to control the brightness code calculation circuit 411 to stop the calculation operation. Furthermore, the counting circuit 414 may control the brightness code calculation circuit 411 to resume the calculation operation after counting to a predetermined number of periods of the PWM signals. Alternately, the counting circuit 414 may detect the PWM signal 401 or the corresponding brightness code 412 to check whether a duty cycle of the PWM signal 401 in a predetermined number of continuous periods are the same. The counting circuit 414 may generate a second control signal 415 in response to that the duty cycle of the PWM signal 401 in a predetermined number of continuous periods are the same and reduce the execution frequency of the brightness code calculation circuit 411 through the second control signal 415. Similarly, the execution frequency of the brightness code calculation circuit 411 may be continuously reduced, without being reduced to 0. In this way, in a condition that the PWM signal 401 temporarily does not change (i.e., the plurality of brightness codes have the same value), the number of times of the calculation of the brightness code calculation circuit 411 may be reduced, thereby indirectly preventing the issue of brightness flickers from occurring to the LED string 420 due to the abnormal state as well as achieving an effect of reducing power consumption at the same time.

It should be noted that even though the first control signal s is not illustrated in FIG. 3, the application is not intent to limit the pattern generation circuit 314 of the embodiment illustrated in FIG. 3 from being capable of simultaneously receiving the first control signal s.

Figure 5:
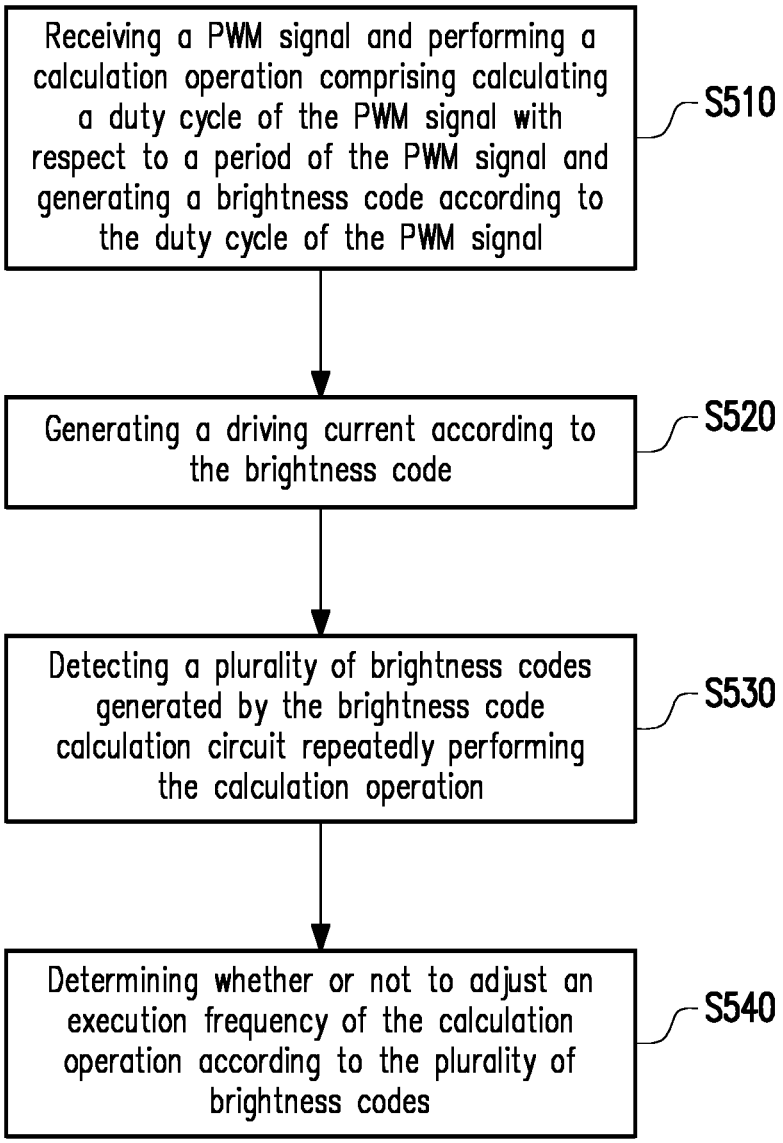
FIG. 5 is a flowchart illustrating of an LED driving method according to an embodiment of the application.

FIG. 5 is a flowchart illustrating of an LED driving method according to an embodiment of the application. Referring to FIG. 5, the LED driving method may include: receiving a PWM signal and performing a calculation operation comprising calculating a duty cycle of the PWM signal with respect to a period of the PWM signal and generating a brightness code according to the duty cycle of the PWM signal (step S510); generating a driving current according to the brightness code (step S520); detecting a plurality of brightness codes generated by the brightness code calculation circuit repeatedly performing the calculation operation (step S530); and determining whether or not to adjust an execution frequency of the calculation operation according to the plurality of brightness codes (step S540). More detailed steps may be inferred with reference to the embodiments illustrated in FIG. 2 to FIG. 4 and thus, will not be repeated.

In light of the foregoing, the execution frequency of the calculation operation of the brightness codes can be reduced according to whether the PWM signal is in the stable state in the application. Furthermore, the calculation operation of the brightness codes can be stopped according to the first control signal. Through the technical means described above, the application can directly or indirectly prevent the issue of brightness flickers from occurring to the LEDs due to the abnormal state. In addition, the effect of reducing static power consumption can be achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light emitting diode (LED) driver, comprising:

a brightness code calculation circuit, configured to receive a pulse width modulation (PWM) signal and perform a calculation operation comprising calculating a duty cycle of the PWM signal with respect to a period of the PWM signal and generating a brightness code according to the duty cycle of the PWM signal; a driving current generation circuit, coupled to the brightness code calculation circuit, and configured to generate a driving current according to the brightness code; and a control circuit, coupled to the brightness code calculation circuit, and configured to detect a plurality of brightness codes generated by the brightness code calculation circuit repeatedly performing the calculation operation and determine whether or not to adjust an execution frequency of the calculation operation of the brightness code calculation circuit according to the plurality of brightness codes.

2. The LED driver according to claim 1, wherein the control circuit is further configured to:

adjust the execution frequency of the calculation operation of the brightness code calculation circuit by generating a control signal sent to the brightness code calculation circuit, in response to a comparison result indicating that the plurality of brightness codes is the same.

3. The LED driver according to claim 1, wherein the control circuit is a dynamic window modulator configured to adjust the execution frequency of the calculation operation of the brightness code calculation circuit according to at least one of a control signal, the PWM signal and the plurality of brightness codes.

4. The LED driver according to claim 1, wherein the brightness code calculation circuit comprises:

a calculation circuit, configured to calculate the duty cycle of the PWM signal with respect to the period of the PWM signal and generate the brightness code according to the duty cycle; and a memory circuit, configured to store the brightness code.

5. An LED driving method, comprising:

receiving a PWM signal and performing a calculation operation comprising calculating a duty cycle of the PWM signal with respect to a period of the PWM signal and generating a brightness code according to the duty cycle of the PWM signal;

generating a driving current according to the brightness code; and detecting a plurality of brightness codes generated by repeatedly performing the calculation operation and determining whether or not to adjust an execution frequency of the calculation operation according to the plurality of brightness codes.

6. The LED driving method according to claim 5, further comprising:

adjusting the execution frequency of the calculation operation by generating a control signal, in response to a comparison result indicating that the plurality of brightness codes is the same.

7. The LED driving method according to claim 5, further comprising:

adjusting the execution frequency of the calculation operation according to at least one of a control signal, the PWM signal and the plurality of brightness codes.

8. The LED driving method according to claim 5, further comprising:

calculating the duty cycle of the PWM signal with respect to the period of the PWM signal and generating the brightness codes; and storing the brightness code.

* * * * *